United States Patent [19]

Chandley

[11] Patent Number: 4,532,976

[45] Date of Patent: Aug. 6, 1985

[54] GAS PERMEABLE METAL CASTING MOLD HAVING GAS COLLECTION VOIDS

[75] Inventor: George D. Chandley, Amherst, N.H.

[73] Assignee: Hitchiner Manufacturing Co., Inc., Milford, N.H.

[21] Appl. No.: 620,314

[22] Filed: Jun. 13, 1984

[51] Int. Cl.[3] ..... B22C 9/08

[52] U.S. Cl. ..... 164/363; 164/255; 164/63; 164/306

[58] Field of Search ..... 164/255, 257, 254, 61, 164/350, 361, 363, 63, 65, 119, 306–311

[56] References Cited

U.S. PATENT DOCUMENTS

| | | | |
|---|---|---|---|
| 3,786,857 | 1/1974 | Sutherland | 164/350 |
| 4,340,108 | 7/1982 | Chandley et al. | 164/63 |
| 4,367,782 | 1/1983 | Schrader | 164/137 |

*Primary Examiner*—Nicholas P. Godici
*Assistant Examiner*—Sam M. Heinrich

[57] ABSTRACT

Unitary, rigid, self-supporting, gas permeable, low temperature bonded, sand grain molds having peripheral side surfaces extending between vertically spaced upper and lower surfaces with mold cavity means spaced therebetween connected to gate passage means having lower open ends exposed at said lower surface, adapted to be filled with molten metal through the gate passage means by applying reduced pressure to the top surface of the mold while its lower surface with the gate passage means lower open ends are submerged in molten metal, are provided with enclosed gas collection void means adjacent to and spaced from each of the mold cavity means, the gate passage means and the upper and lower mold surfaces for collecting gases from the cavity means and gate passage means during filling of the cavity means for controlled removal of gases from the void means through the upper mold surface by application of reduced pressure thereto.

10 Claims, 8 Drawing Figures

GAS PERMEABLE METAL CASTING MOLD HAVING GAS COLLECTION VOIDS

CROSS REFERENCES TO RELATED APPLICATIONS

This application is related to U.S. Pat. No. 4,340,108, issued July 20, 1982 and for U.S. patent application Ser. No. 574,938 filed Jan. 27, 1984, both of which are incorporated by reference herein.

BACKGROUND OF THE INVENTION

The unitary, rigid, self-supporting, gas permeable, low temperature bonded, sand grain molds described in that patent and application have, over the past several years, succeeded in replacing the more expensive high temperature resistant ceramic molds in many applications. However, in certain applications, such as those in which the lower end of the mold cavity extends for a considerable distance below the surface of the molten metal which is drawn up through the gate passage and into the mold cavity by application of reduced pressure to the upper surface of the mold, gas defects, resulting in ruined cast parts, have at times been a problem. In addition, the thickness of the cast parts had sometimes been limited by the appearance of gas defects as the thickness of the parts increased.

1. Field of the Invention

This invention relates to metal casting in unitary, rigid, self-supporting, gas permeable, low temperature bonded, sand grain molds having one or more mold cavities adapted to be filled with molten metal by applying reduced pressure to the top surface of the mold while the lower surface of the mold with the mold cavity gate passage open ends is submerged in molten metal. More particularly, it relates to improvements in such molds which makes it possible to cast in such molds certain types of parts, particularly those having deep mold cavities and those of increased wall thickness, free from the gas defects which otherwise would be expected.

2. Description of the Prior Art

The present invention, similarly to the inventions of the patent and application, is concerned only with molds of the low temperature bonded, sand grain type, which "self-destruct" in the presence of molten ferrous metals in a matter of seconds. Such molds have been used for decades in gravity casting, although in a much different construction in which the gate passages extended along the mold parting plane from the mold cavities and terminated with their open ends at the side or top of of the mold in the mold parting plane.

However, until the inventions of the patent and application, which require a unique mold construction in which at least portions of the gate passages extend perpendicularly to the mold parting plane and terminate with their open ends at the lower mold surface, such low temperature bonded, sand grain molds had never been successfully used in vacuum casting, although their cost advantages over high temperature ceramic molds had long been known. The prior art, then, is properly limited to such molds.

SUMMARY OF THE INVENTION

This invention is concerned with unitary, rigid, self-supporting, gas permeable, low temperature bonded, sand grain molds having peripheral side surfaces extending between vertically spaced upper and lower surfaces with mold cavity means spaced therebetween, connected to gate passage means having its lower open end exposed at the lower mold surface, adapted to be filled with molten metal through the gate passage means by applying reduced pressure to the top surface of the mold while its lower surface with the gate passage means lower open end is submerged in molten metal.

The invention comprises the unique provision of enclosed gas collection void means adjacent to and spaced from each of the mold cavity means, the gate passage means and the upper and lower mold surfaces for collecting gases from the cavity means and gate passage means during filling of the cavity means for their controlled removal from the enclosed void means through the upper mold surface by application of reduced pressure thereto.

DESCRIPTION OF THE PREFERRED EMBODIMENTS

Figure 1:
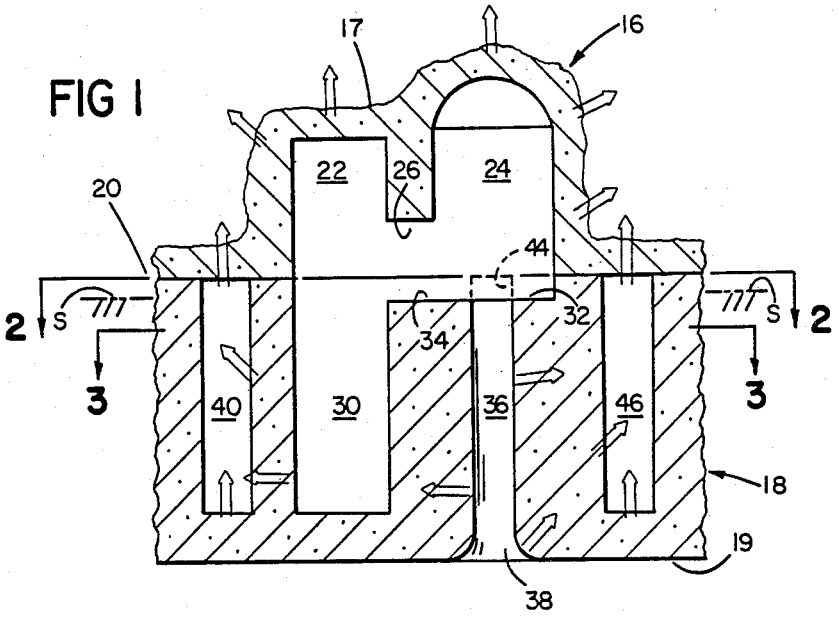
FIG. 1 is a partial side view of a first embodiment of a mold according to the invention.

Referring to the drawings, the molds partially shown therein, including but a single mold cavity, are generally of the type shown and described in the patent and application and may have a plurality of mold cavities located in a horizontal plane for simultaneous filling of the mold cavities by application of reduced pressure to the upper surface of the gas permeable mold while its lower surface with the open gate passage ends is submerged beneath the surface of molten metal.

Figure 2:
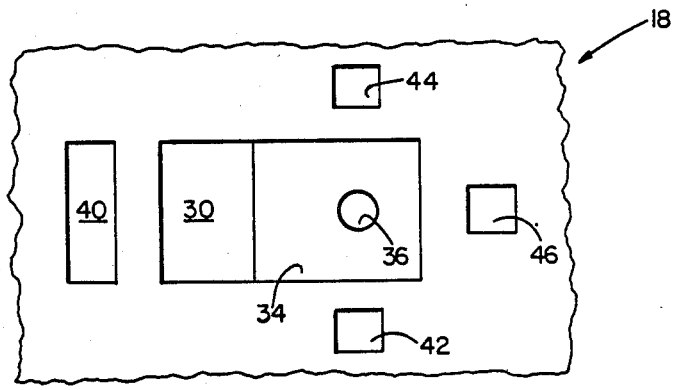
FIG. 2 is a partial top view of the lower half shell of the mold of FIG. 1, taken along mold parting line 2—2 of FIG. 1.
Figure 3:
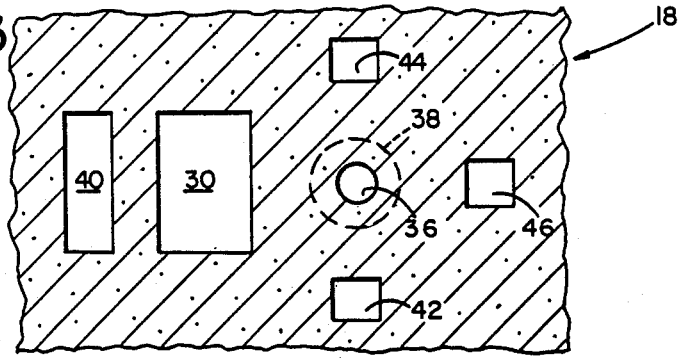
FIG. 3 is a partial sectional top view of the lower half shell of the mold of FIG. 1, taken along section line 3—3 of FIG. 1.
Figure 4:
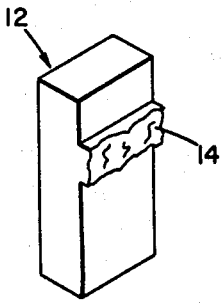
FIG. 4 is an isometric view of the part cast in the mold of FIGS. 1–3, with its gate shown broken away.

A first embodiment of the mold of the invention is shown in FIGS. 1–3. The rectangular cast part 12, with its gate 14 shown as broken away, is shown in FIG. 4.

Referring to FIGS. 1–3, the first embodiment of the mold of the present invention, like the molds of the patent and application, comprises a gas permeable, low temperature bonded, sand grain upper mold half, generally designated 16, and a gas permeable, low temperature bonded, sand grain lower mold half, generally designated 18. The mold halves 16 and 18 are adhesively secured together in a generally horizontal mold parting plane 20 with the upper mold surface 17 and lower mold surface 19 vertically spaced on opposite sides of mold parting plane 20 with peripheral side surfaces extending there between.

Upper mold half 16 has, in its lower surface at parting plane 20, upwardly extending recesses providing mold cavity upper portion 22, blind riser upper portion 24 and horizontal ingate upper portion 26. Upper mold half 16 is made by the usual technique of distributing the loose sand and bonding material mixture and baking it to harden it over metallic half patterns which define the patterns of the recesses mounted on a metal base plate which defines the parting plane 20 to provide an upper mold half 16 having a more or less uniform outer wall thickness, as can be seen in FIG. 1.

Lower mold half 18 has, in its upper surface at parting plane 20, cooperating downwardly extending recesses providing a deep mold cavity lower portion 30, a blind riser lower portion 32 and a horizontal ingate lower portion 34. A narrow gate passage 36 extends vertically downwardly from blind riser lower portion 32 with its lower open end 38 exposed at lower mold surface 19.

The present invention provides novel enclosed gas collection voids adjacent to and spaced from each mold cavity and gate passage, as well as from the upper and lower mold surfaces. In operation, after the lower half shell 18 is submerged beneath the surface S of molten metal along a horizontal line parallel to and slightly beneath parting plane 20, these voids function to collect gases displaced from the gate passage and the mold cavity by the molten metal as it enters first the gate passage and then the mold cavity, during filling of the mold cavity, for its controlled removal through the upper mold surface during the application of reduced pressure to the upper mold surface, as shown by the gas flow arrows in FIGS. 1–3, in order to prevent gas defects which might otherwise occur.

More specifically, the invention provides, in lower mold half 18, a plurality of gas collection voids having closed lower ends adjacent to and spaced from lower mold lower surface 19 and extending to mold parting plane 20. As shown in FIGS. 1–3, these include mold cavity void 40 adjacent to and of approximately the same width as deep mold cavity lower portion 30 and spaced from its side opposite gate passage 36; side mold cavity voids 42 and 44 spaced on opposite sides of gate passage 36; and gate passage void 46 spaced from gate passage 36 on the opposite side of gate passage 36 from mold cavity lower portion 30, voids 42, 44 and 46 being of approximately the same cross-section as gate passage 36.

When upper and lower mold halves 16 and 18 are adhered by a suitable adhesive around the periphery of parting line 20, upper mold half 16 covers the open upper ends of voids 40, 42, 44 and 46 to provide enclosed gas collection voids for collecting gases during filling of the mold cavity for their controlled removal through upper mold half 16.

Another feature of the invention is the provision of a flat, generally planar lower surface 19 on lower mold half 18, so that its lower surface is free from recesses extending between a mold cavity, gate passage or gas collection void into which molten metal could enter and disturb the desired flow of gases to the gas collection voids.

According to an additional feature of the present invention, gate passage lower open end 38 is preferably radiused, as shown in FIG. 1, for improved control of gas removal during filling.

Figure 5:
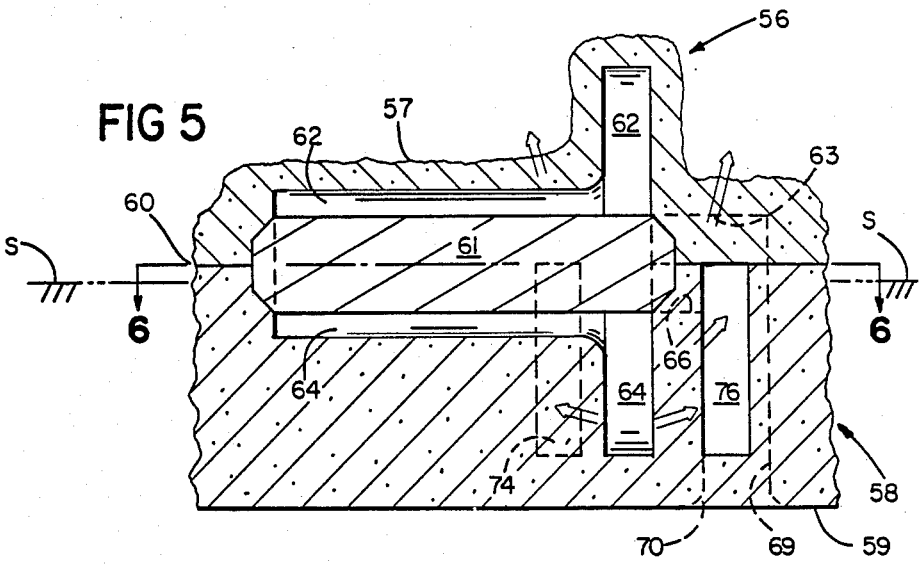
FIG. 5 is a partial side view of a second embodiment of a mold according to the invention.
Figure 6:
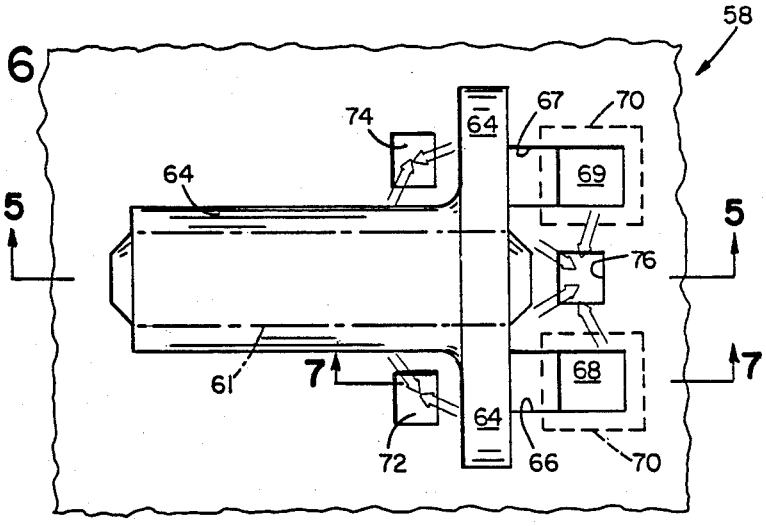
FIG. 6 is a partial top view of the lower half shell of the mold of FIG. 5, taken along mold parting line 6—6 of FIG. 5.
Figure 8:
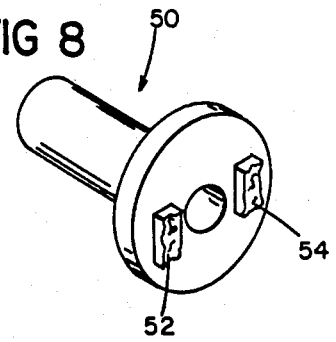
FIG. 8 is an isometric view of the part cast in the mold of FIGS. 5–7, with its gates shown broken away.
Figure 7:
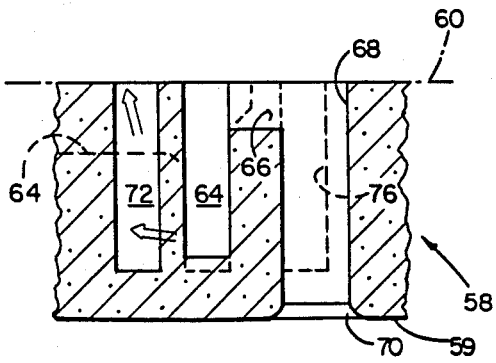
FIG. 7 is a partial sectional side view of the lower half shell of the mold of FIG. 5, taken along section line 7—7 of FIG. 6.

A second embodiment of the mold of the invention is shown in FIGS. 5–7. The hollow pipe flange cast part 50, with its gates 52 and 54, shown as broken away, is shown in FIG. 8.

Referring to FIGS. 5–7, the second embodiment of the mold of the present invention also comprises a gas permeable, low temperature bonded, sand grain upper mold half, generally designated 56, and a gas permeable, low temperature bonded, sand grain lower mold half, generally designated 58, with a generally cylindrical core 61 incorporated therebetween. The mold halves 56 and 58 with core 61 therein are adhesively secured together around their peripheries in a generally horizontal mold parting plane 60 with the upper mold surface 57 and lower mold surface 59 vertically spaced on opposite sides of mold parting plane 60 with peripheral side surfaces extending therebetween and with core 61 within the assembled mold with its axis extending along parting plane 60.

Upper mold half 56 has, in its lower surface at parting plane 60, upwardly extending recesses providing mold cavity upper portion 62 having semi-circular frusto-conical ends for receiving the frusto-conical ends of cylindrical core 61 and transversely spaced, horizontal ingate upper portions 63. Upper mold half 56 is made in the same manner as upper mold half 16 as described above and core 61 is made of the same mixture and is also baked to provide a solid, gas permeable core 61 which is assembled between the mold halves to provide a hollow, cylindrical part 50, as shown in FIG. 8.

Lower mold half 58 has, in its upper surface at parting plane 60, cooperating downwardly extending recesses providing a flanged, semi-cylindrical mold cavity lower portion 64 and transversely spaced, lower horizontal ingate portions 66 and 67. Transversely spaced, narrow gate passages 68 and 69 extend vertically downwardly from the ends of ingate lower portions 66 and 67 with their lower open ends 70 exposed at lower mold surface 59.

The second embodiment of the invention also provides novel enclosed gas collection voids adjacent to and spaced from each mold cavity and gate passage, as well as spaced from the upper and lower mold surfaces. In operation, after the lower half shell 58 is submerged beneath the surface S of molten metal along a horizontal line parallel to and slightly beneath parting plane 60, these voids function to collect gases displaced from the gate passages and the mold cavity by the molten metal as it enters first the gate passage and then the mold cavity, during filling of the mold cavity, for its controlled removal through the upper mold surface during the application of reduced pressure to the upper mold surface, as shown by the gas flow arrows in FIGS. 5–7, in order to prevent gas defects which would otherwise occur.

More specifically, the second embodiment of the invention provides, in lower mold half 58, a plurality of gas collection voids having closed lower ends adjacent to and spaced from lower mold lower surface 59 and extending to mold parting plane 60. As shown in FIGS. 5–7, these include transversely spaced mold cavity voids 72 and 74 adjacent the opposite sides of the flange portion of mold cavity lower portion 64 and spaced from its side opposite gate passages 68 and 69 and gate passage void 76 spaced between gate passages 68 and 69.

When upper and lower mold halves 56 and 58 are adhered by a suitable adhesive around the periphery of parting line 60, upper mold half 56 covers the open upper ends of voids 72, 74 and 76 to provide enclosed gas collection voids for collecting gases during filling of the mold cavity for their controlled removal through upper mold half 56.

Lower surface 59 on lower mold half 58 is also generally flat and planar, so that its lower surface is free from recesses extending between a mold cavity, gate passage or gas collection void into which molten metal could enter and disturb the desired flow of gases to the gas collection voids.

Gate passage lower open ends 70 are also preferably radiused, as shown in FIGS. 5 and 7, for improved control of gas removal during filling.

Further modifications of the invention, within the spirit thereof and the scope of the appended claims, will occur to those skilled in the art.

I claim:

1. In a unitary, rigid, self-supporting, gas permeable, low temperature bonded, sand grain mold having peripheral side surfaces extending between vertically spaced upper and lower surfaces with mold cavity means spaced therebetween connected to gate passage means having its lower open end exposed at said lower surface, said mold cavity means being adapted to be filled with molten metal through said gate passage means by applying reduced pressure to the top surface of said mold while its lower surface with said gate passage means lower open end is submerged in molten metal, that improvement comprising enclosed gas collection void means adjacent to and spaced from said cavity means, gate passage means and upper and lower mold surfaces for collecting gases from said cavity means and gate passage means during filling of said cavity means for controlled removal of said gases from said void means through said upper mold surface by said application of reduced pressure thereto.

2. In a mold as claimed in claim 1, wherein said void means includes a plurality of void means, at least one of said void means being located adjacent said mold cavity means and at least one of said void means being located adjacent said gate passage means.

3. In a mold as claimed in claims 1 or 2 that further improvement comprising providing a lower mold surface free from recesses extending between said gate passage means, cavity means and void means for improved control of gas flow from said gate means and cavity means to said void means.

4. In a mold as claimed in claim 3 that further improvement comprising providing said gate passage means with a radiused lower open end for improved control of gas flow to said void means.

5. A unitary, rigid, self-supporting, gas permeable, low temperature bonded, sand grain mold having peripheral side surfaces extending between vertically spaced upper and lower surfaces with mold cavity means spaced therebetween connected to gate passage means having its lower open end exposed at said lower surface, said mold cavity means being adapted to be filled with molten metal through said gate passage means by applying reduced pressure to the top surface of said mold while its lower surface with said gate passage means lower open end is submerged in molten metal, said mold comprising gas permeable upper and lower mold halves adhesively secured together in a generally horizontal mold parting plane with said upper and lower surfaces vertically spaced on opposite sides of said mold parting plane said lower mold half having lower mold half cavity means extending to said generally horizontal mold parting plane lower mold half gate passage means having its lower open end exposed at said lower mold surface, and lower mold half gas collection void means extending to said generally horizontal mold parting plane adjacent to and spaced from said lower mold half cavity means, lower mold half gate passage means and lower mold half lower surface said upper mold half covering said lower mold half void means to provide enclosed gas collection void means adjacent to and spaced from said cavity means, gate passage means and upper and lower mold surfaces for collecting gases from said cavity means and gate passage means during filling of said cavity means for controlled removal of said gases from said void means through said upper mold half surface by said application of reduced pressure thereto.

6. A mold as claimed in claim 5, wherein said lower mold half lower surface is free from recesses extending between said gate passage means, cavity means and void means for improved control of gas flow from said gate means and cavity means to said void means.

7. A mold as claimed in claims 5 or 6, wherein said gate passage means includes a vertical portion and a horizontal portion connecting said vertical portion to said lower mold half cavity means.

8. A unitary, rigid, self-supporting, gas permeable, low temperature bonded, sand grain mold having peripheral side surfaces extending between vertically spaced upper and lower surfaces with mold cavity means spaced therebetween connected to gate passage means having its lower open end exposed at said lower surface, said mold cavity means being adapted to be filled with molten metal through said gate passage means by applying reduced pressure to the top surface of said mold while its lower surface with said gate passage means lower open end is submerged in molten metal, said mold comprising gas permeable upper and lower mold halves adhesively secured together in a generally horizontal mold parting plane with said upper and lower surfaces vertically spaced on opposite sides of said mold parting plane said lower mold half having lower mold half cavity means extending to said generally horizontal mold parting plane lower mold half gate passage means having a vertical portion with its lower open end exposed at said lower mold surface and a horizontal portion connecting said vertical portion with said mold cavity means said lower mold half lower surface being free from recesses extending between said gate passage means, cavity means and void means for improved control of gas flow from said gate means and cavity means to said void means, and a plurality of lower mold gas collection void means extending to said generally horizontal mold parting plane and adjacent to and spaced from said lower mold half lower surface, at least one of said void means being located adjacent a side of said mold cavity means opposite said horizontal gate passage portion and at least one of said void means being located on the other side of said mold cavity means adjacent said gate passage means vertical portion, and said upper mold half having upper mold half cavity means extending to said generally horizontal mold parting plane said upper mold half covering said lower mold half void means to provide enclosed gas collection void means adjacent to and spaced from said cavity means, gate passage means and upper and lower mold surfaces for collecting gases from said cavity means and gate passage means during filling of said cavity means for controlled removal of said gases from said void means through said upper mold half surface by said application of reduced pressure thereto.

9. A mold as claimed in claims 7 or 8, wherein said lower mold half further includes riser cavity means connected between said vertical and horizontal gate passage means portions.

10. A mold as claimed in claims 5, 6, 8 or 9, wherein said gate passage means has a radiused lower open end for improved control of gas flow to said void means.

* * * * *